US006790062B1

(12) United States Patent
Liao

(10) Patent No.: US 6,790,062 B1
(45) Date of Patent: Sep. 14, 2004

(54) ADAPTER STRUCTURE

(76) Inventor: Sheng-Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 10/642,729

(22) Filed: Aug. 19, 2003

(51) Int. Cl.[7] ..... H01R 13/44
(52) U.S. Cl. ..... 439/171; 439/501; 439/956
(58) Field of Search ..... 439/171, 166, 439/170, 172, 174, 217–8, 956–957

(56) References Cited

U.S. PATENT DOCUMENTS 5,791,921 A * 8/1998 Lee ..... 439/172
6,126,460 A * 10/2000 Wu ..... 439/172
6,402,546 B1 * 6/2002 Groves et al. ..... 439/172
6,659,782 B2 * 12/2003 Wu ..... 439/172

* cited by examiner

*Primary Examiner*—Renee Luebke
(74) *Attorney, Agent, or Firm*—Rosenberg, Klein & Lee

(57) ABSTRACT

An adapter structure, suitable for use in different electricity standards, has a casing, a first plug, a second plug, a pair of conductors and a pair of insertion holes. The first plug has two straight pins pivotally connected to the casing so that the straight pins are unfolded from the casing or stored inside the casing. The second plug has two rod-shaped pins with rear ends respectively connected to a base. By pushing a pushing button, the plug moves forth and back inside the casing to unfold or store the rod-shaped pins inside the casing. The conductors are mounted inside the casing in parallel and respectively electrically connected to the first and second plugs, corresponding to outlets of the conductors. Therefore, the plugs of the adapter are respectively compatible with UK and EU electricity standards, with a simple configuration and reduced production cost.

11 Claims, 12 Drawing Sheets

ADAPTER STRUCTURE

BACKGROUND OF THE INVENTION

1. Field of the Invention

The invention relates to an adapter structure having plugs compatible with various electricity standards and having a small size.

2. Description of the Related Art

An adapter typically has a plug and a pair of insertion holes. The plug of the adapter is used to connect to domestic electricity to supply power to conductors inside the adapter. The conductors are mounted corresponding to the insertion holes. When a plug of an electrical appliance is inserted into an electrical socket via the insertion holes of the adapter, the plug comes into contact with the conductors to supply power to the electrical appliance. Such an adapter has only one plug that is not compatible with different electricity standards.

Another type of adapter with various plugs compatible with US, UK and European electricity standards has been commercially available. This conventional adapter allows the user to choose one of the plugs according to the type of electrical socket in place. This type of adapter is convenient because there is no need to buy various adapters for each electricity standard.

Referring to FIG. 1 and FIG. 2, a conventional adapter having various types of plugs includes a casing 90, a first plug 91, a second plug 96, a third plug 100, a pair of conductors 102, and a pair of insertion holes 103. Each first plug 91 includes a pair of rectangular pins 92 and a first portion 93 slidably mounted on the casing 90. A movable fastener 94 moves the first plug 91 forth and back in the casing 90. A rectangular ground pin 95 is pivotally connected to a front side of the casing 90. When the first plug 91 is pushed forward, the rectangular ground pin 95 is driven outward by the first plug 91 to form a third rectangular pin for connection to one domestic electricity standard. The second plug 96 includes a pair of straight pins 97 and a second portion 98 slidably mounted on the casing 90. A movable fastener 98 moves the second plug 92 forth and back in the casing 90. When the straight pins 97 are pushed outward, they can be inserted in another domestic electricity standard. The third plug 100 includes a pair of rod-shaped pins 101 pivotally connected on and unfolded from the front side of the casing 90 for insertion into an electrical socket of yet another electricity standard. The conductors 102 are mounted inside the casing 90 in parallel and respectively electrically connected to the corresponding plugs 91, 92 for inputting various types of electricity standards. The insertion holes 103 are formed through a rear side of the casing 90 to correspond to a pair of outlets of the conductors 102 for receiving a pair of pins of an electric plug of an external electrical appliance to supply electrical power.

However, the plugs 91, 96, 100 of the above conventional adapter exclusively connect to different electric sockets of specific electricity standards. The plugs 91, 96, 100 cannot commonly insert into one electric socket of a certain domestic electricity standard. Therefore, if the adapter has to accommodate all the plugs, the size and production cost of the adapter should be increased with a complex structure.

SUMMARY OF THE INVENTION

It is therefore an object of the invention to provide an adapter structure having plugs with different electricity standards, in which the user conveniently chooses one proper plug according to the domestic electricity standard, for example UK or EU electricity standards. The adapter structure of the invention has a simple structure with a reduced size and production cost.

In order to achieve the above and other objectives, the adapter structure of the invention includes a casing, a first plug, a second plug, a pair of conductors and a pair of insertion holes. The first plug has two straight pins pivotally connecting to the casing so that the straight pins are unfolded from the casing or stored up inside the casing. The second plug has two rod-shaped pins with rear ends respectively connected to a base. By pushing a pushing button, the plug moves forth and back inside the casing to unfold or store the rod-shaped pins inside the casing. The conductors are mounted inside the casing in parallel and respectively electrically connected to the first and second plugs, corresponding to outlets of the conductors.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1:
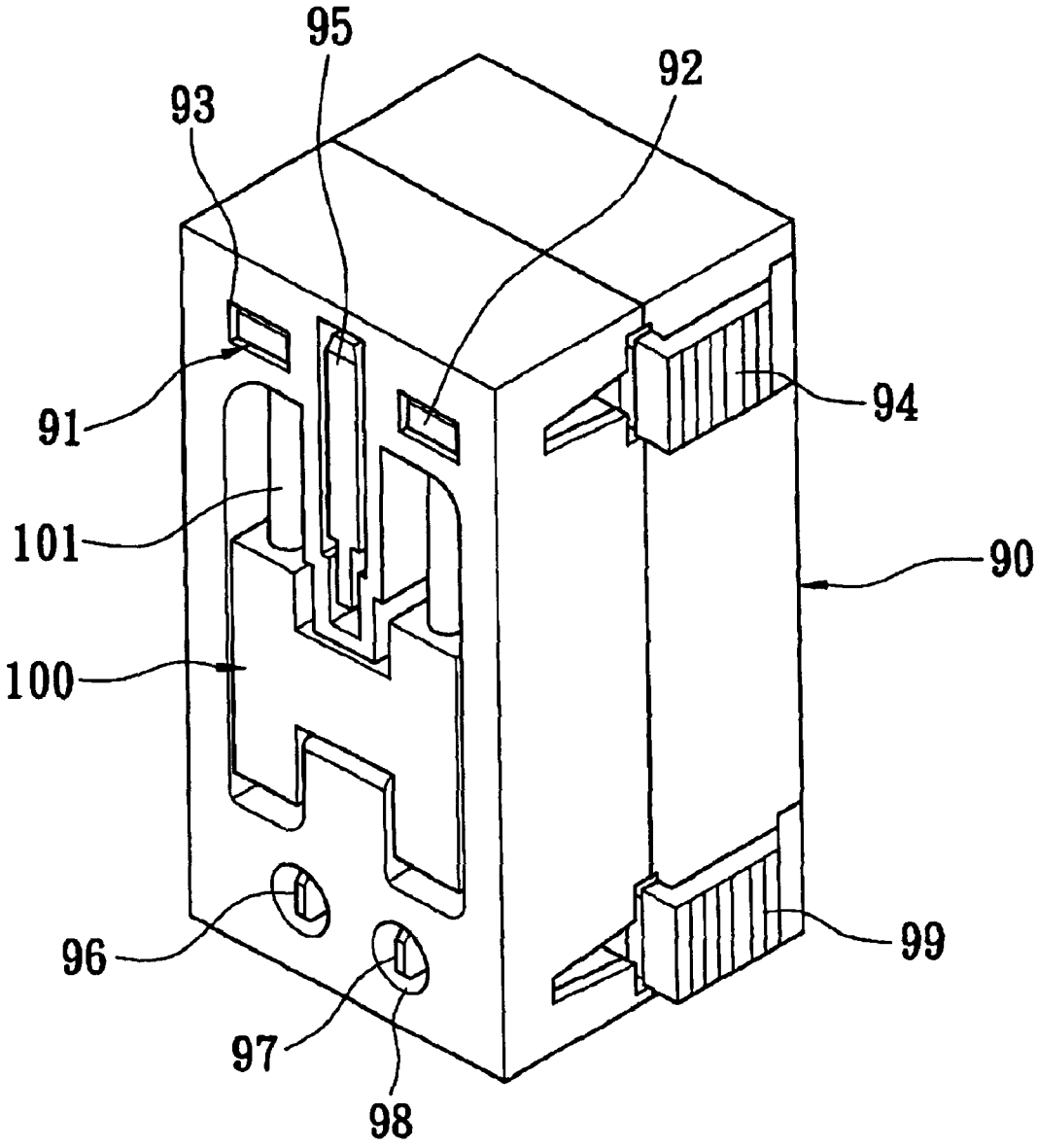
FIG. 1 PRIOR ART
FIG. 1 is a perspective view of a conventional adapter.
Figure 2:
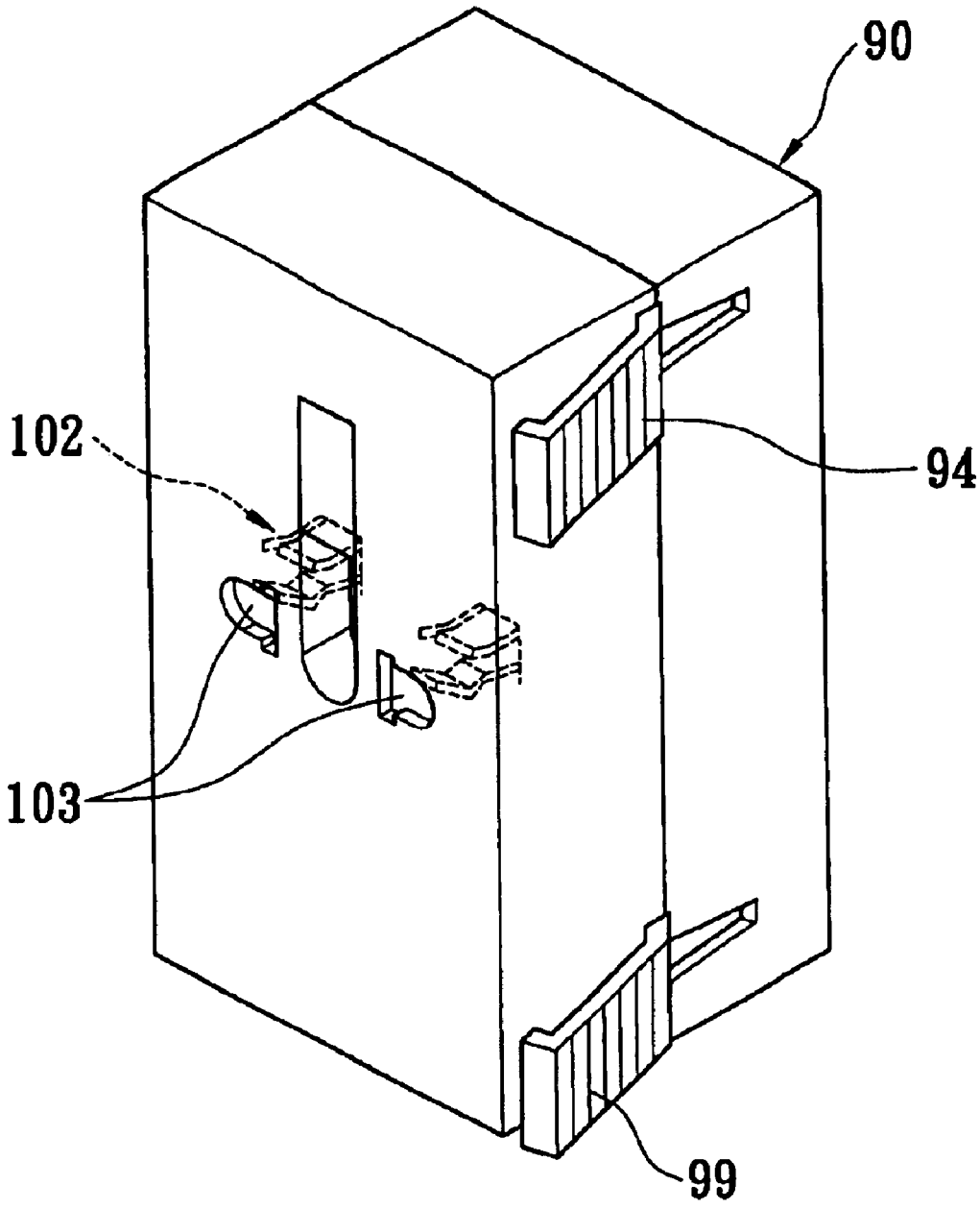
FIG. 2 PRIOR ART
FIG. 2 is perspective view of a conventional adapter taken from a different angle of view.
Figure 3:
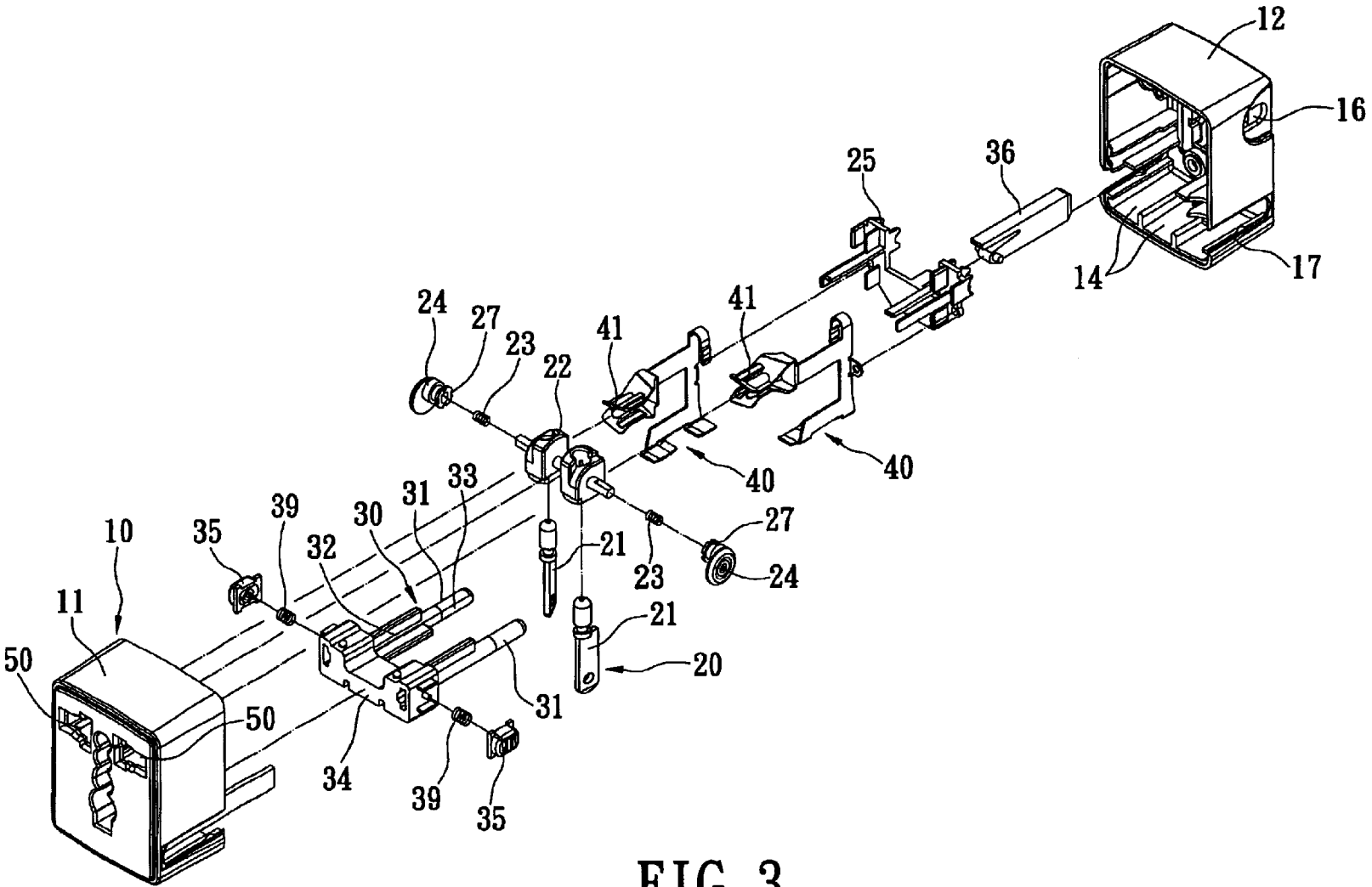
FIG. 3 is an exploded view of an adapter structure according to a first embodiment of the invention.
Figure 4:
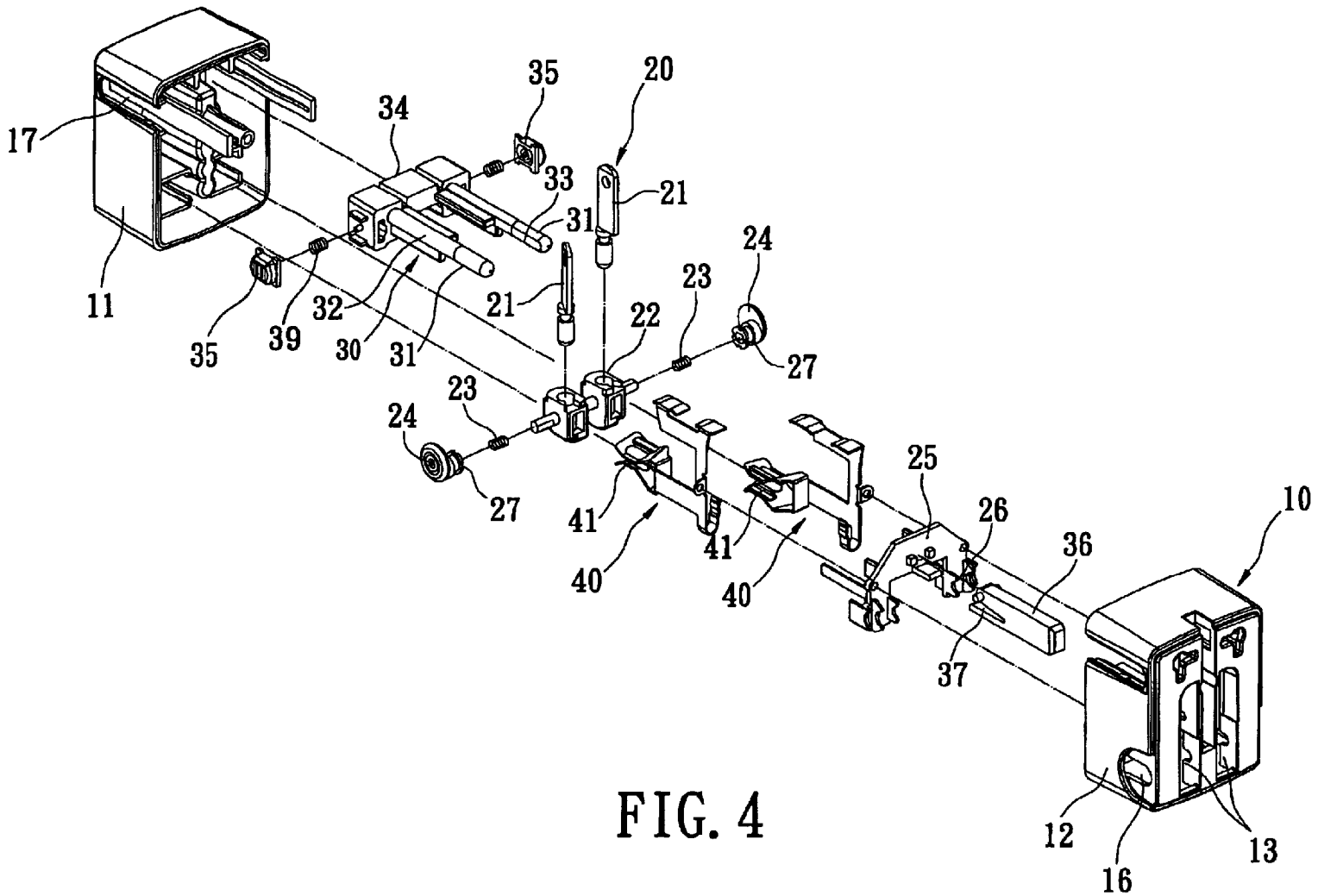
FIG. 4 is an exploded view of an adapter structure taken from a different angle of view according to a first embodiment of the invention.
Figure 5:
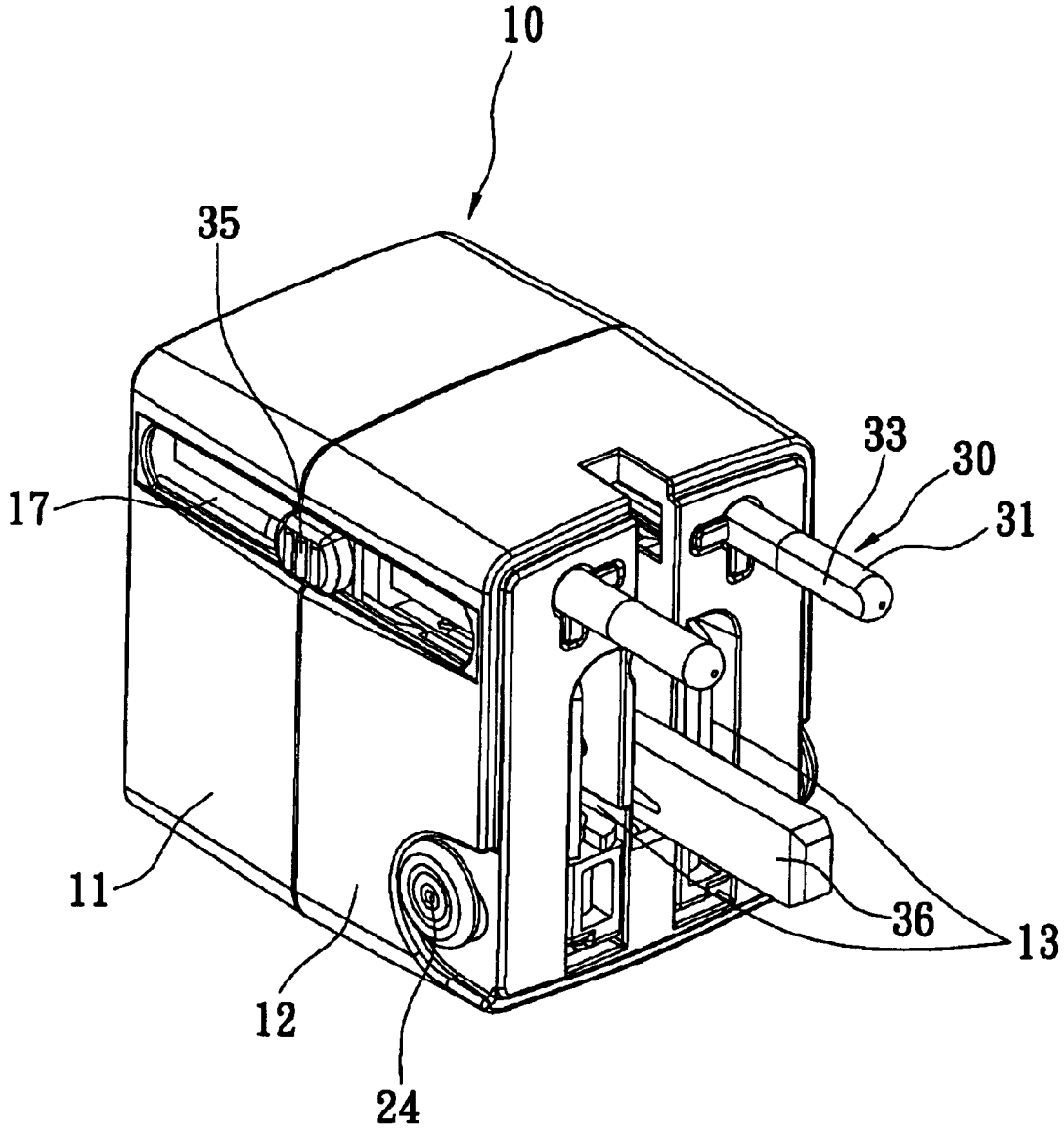
FIG. 5 is a perspective view of an adapter structure according to a first embodiment of the invention.

Wherever possible in the following description, like reference numerals will refer to like elements and parts unless otherwise illustrated.

Referring to FIG. 3 to FIG. 6, an adapter structure according to the invention suitable for different power standards includes a casing 10, a first plug 20, a second plug 30, a pair of conductors 40, and a pair of insertion holes 50. The casing 10 is a hollow casing made of plastic, having a first casing portion 11 and a second casing portion 12 snap-fitted or screwed together. The casing 10 accommodates the first plug 20, the second plug 30, the conductors 40 and the insertion holes 50 therein. A first part 13 and a second part 14 are respectively formed at a front side and an interior side.

The first plug 20 includes a pair of straight pins 21 made of conductive material. The straight pins 21 are securely inserted in a connection base 22. The connection base 22 pivotally connects to corresponding pivotal holes 16 of the casing 10. A spring 23 and a cover 24 are pivotally mounted on two sides of the connection base 22 to resiliently hold the connection base 22, so that the straight pins 21 pivotally connect to the front side of the casing 10 to unfold from the casing 10 (as shown in FIG. 7) or be stored inside the first part 13 of the casing 10.

A positioning sheet 25 having two protuberances 26 thereon is mounted in the casing 10. On the cover 24 facing the spring 23 is formed a plurality of first slots 27 that are equally spaced from one another at 90 degrees. When the straight pins 21 are rotated to unfold from the casing 10 or be stored inside the first part 13 of the casing 10, the covers 24 on the two sides of the connection base 22 are firmly positioned by snap-fitting the protuberances 26 to the first slots 27.

Figure 7:
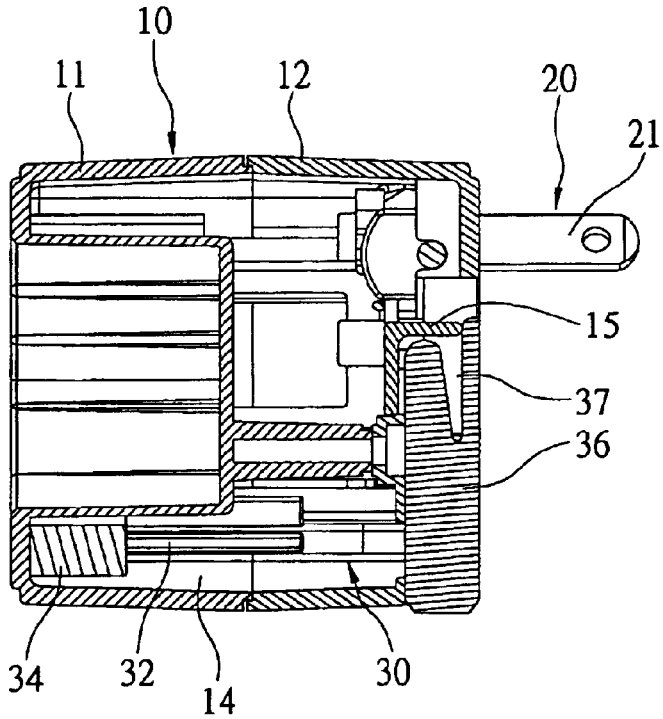
FIG. 7 is a schematic view (I) showing the operation of an adapter structure according to a first embodiment of the invention.

Referring to FIG. 7, when the straight pins 21 are unfolded from the casing 10, the pins 21 can be inserted into an electrical socket of a first type of domestic electricity, and the first plug 20 is designated as a US standard plug for use in an electrical socket compatible with the US electricity standard in this embodiment.

The second plug 30 includes a pair of rod-shaped pins 31 whose rear ends respectively connect to a base 32. The rod-shaped pins 31 protrude from a front side of the base 32 with a predetermined length. An undercut 33 is formed inside each of the rod-shaped pins 31. A sliding piece 34 is detachably mounted on a rear side of the base 32. A pushing button 35 is mounted on an external surface of the sliding piece 34. A spring 39 is mounted between the sliding piece 34 and a pushing button 35. The two pushing buttons 35 respectively slide along corresponding slide guides 17 that are formed on the opposite sides of the casing 10. The sliding piece 34 allows the rod-shaped pins 31 to slidably mount inside the second part 14 of the casing 10. Slidably mounting the rod-shaped 31 inside the second part 14 of the casing 10 is achieved by pushing the pushing buttons 35 to drive the rod-shaped pins 31 of the second plug 30 to slide out of and back into the casing 10. Thereby, the rod-shaped pins 31 are extended from or stored inside the casing 10. Either only the rod-shaped pins 31 are extended from the front side of the casing 10 or both the rod-shaped pins 31 and the base 32 are extended out of the front side of the casing 10.

The second plug 30 further includes a rectangular ground pin 36. The ground pin 36 pivotally connects to the front side of the casing 10 to rotate the ground pin 36 to unfold forward or be stored inside the casing 10 as desired. The ground pin 36 has a second slot 37 at its rear end. A first positioning member 15 is mounted on the casing 10. When the ground pin 36 is rotated to unfold forward, the second slot 37 of the ground pin 36 snap fits to a second positioning member 15 so that the ground pin 36 is firmly unfolded in forward position, as shown in FIG. 8.

Figure 8:
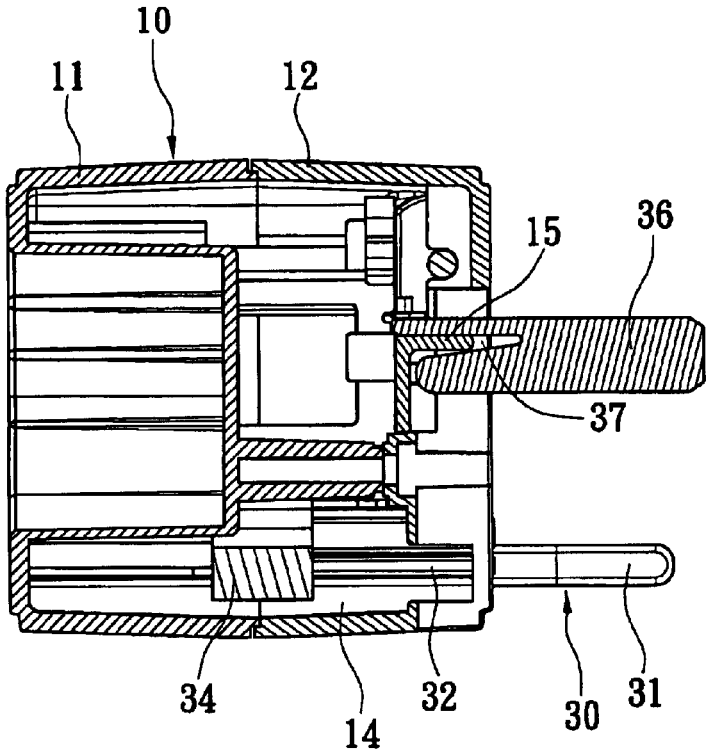
FIG. 8 is a schematic view (II) showing the operation of an adapter structure according to a first embodiment of the invention.

Referring to FIG. 8, the rod-shaped pins 31 and the ground pin 36 are unfolded forward to form three-legged pins for use in an electrical socket of a second type of domestic electricity standard. The second plug 30 is compatible with, for example, the UK electricity standard in this embodiment. The rod-shaped pins 31 respectively have undercuts 33 to prevent obstruction caused by a small pitch between two rectangular insertion holes of the UK standard socket.

Figure 9:
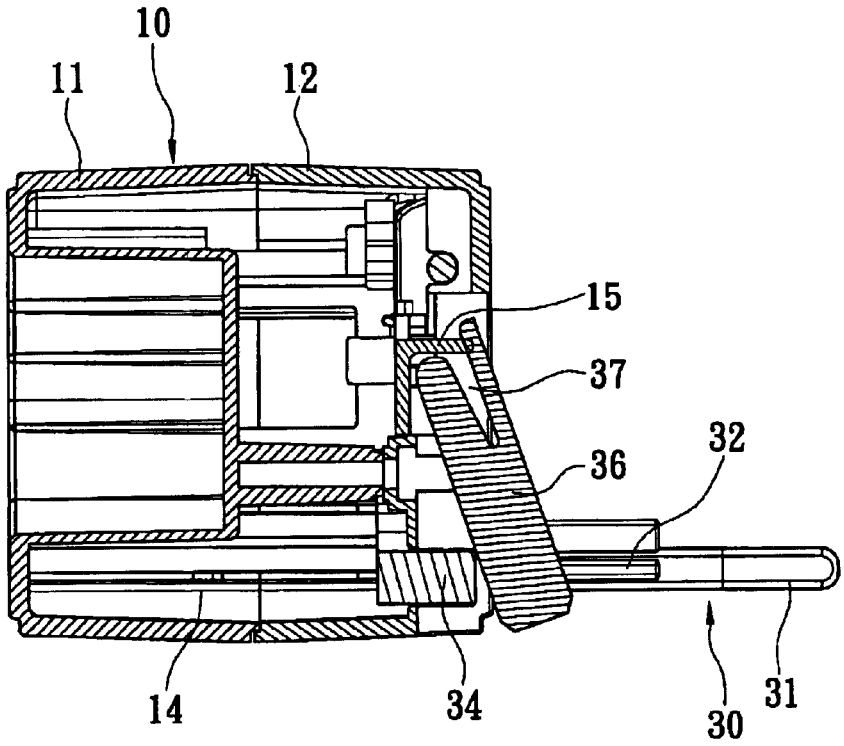
FIG. 9 is a schematic view (III) showing the operation of an adapter structure according to a first embodiment of the invention.

Referring to FIG. 9, the rod-shaped pins 31 and the base 32 are unfolded forward and the ground pin 36 is withdrawn to form two-legged pins for use in an electrical socket of a third type of electricity standard. The second plug 30 is compatible with, for example, the EU standard in this embodiment. The rod-shaped pins 31 are inserted in round insertion holes of the socket.

The conductors 40 are made of conductive material and arranged in parallel inside the casing 10. The conductor 40 is electrically connected to the pins 21, 31 of the first and second plugs 20, 30 for receiving the first and second plugs 20, 30 of different electricity standards. The conductors 40 respectively have output receptacles 41.

Figure 6:
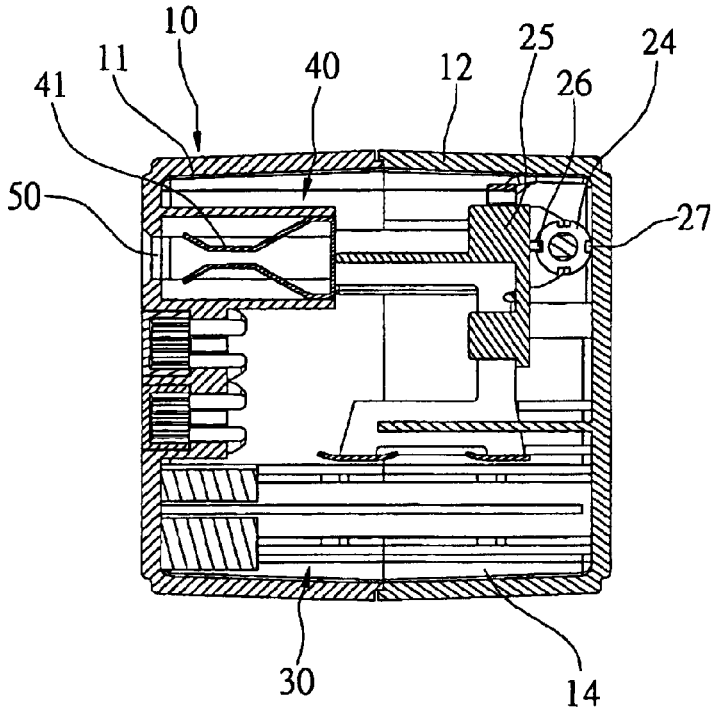
FIG. 6 is a cross-sectional view of an adapter structure according to a first embodiment of the invention.

The insertion holes 50 are formed in the rear side of the casing 10 to correspond to outlets 41 (as shown in FIG. 6) for receiving a pair of pins of an external appliance for power supply via the first and second plugs 20, 30. Thereby, the adapter structure of the invention is accomplished.

Figure 10:
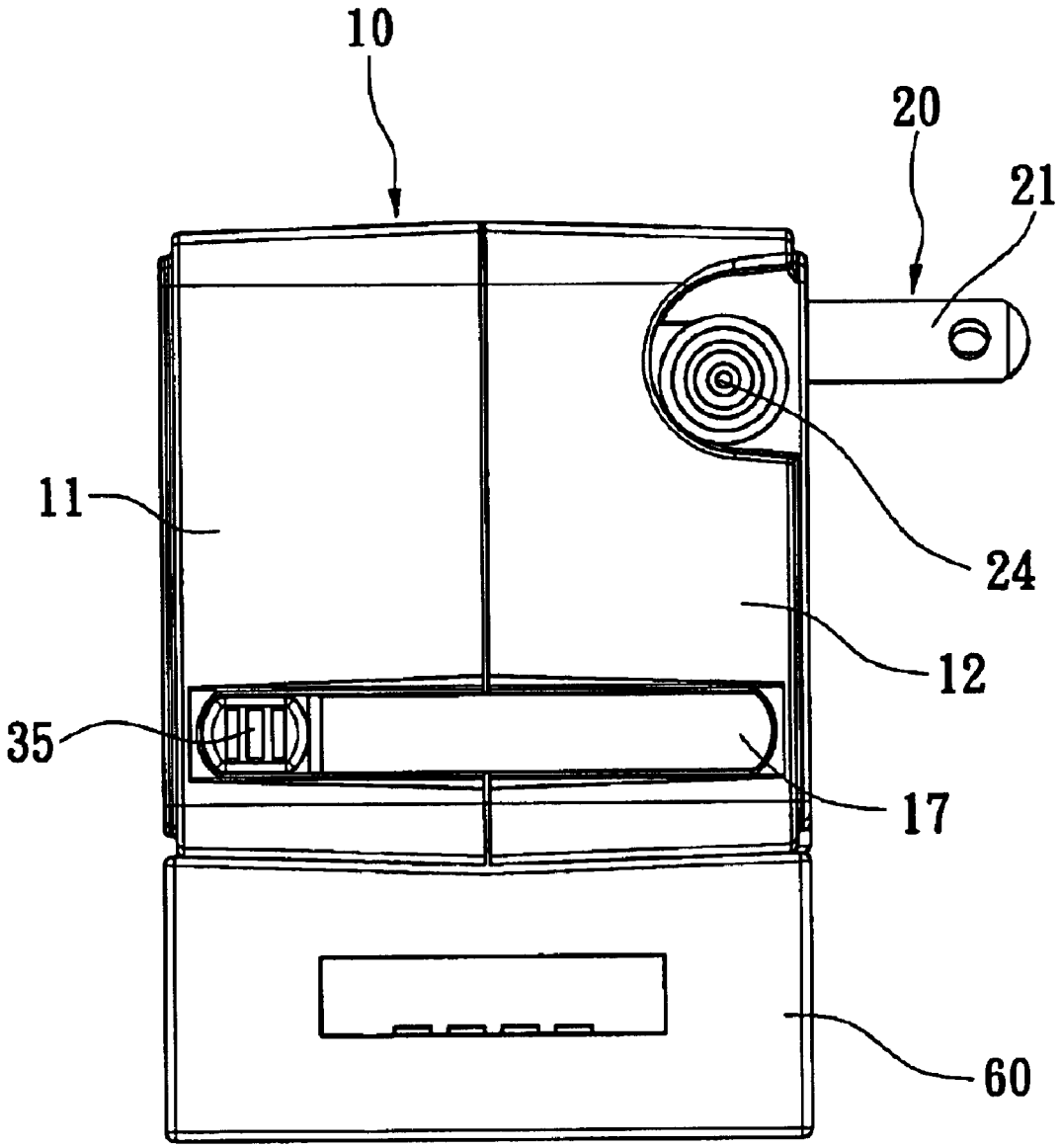
FIG. 10 is a side view of an adapter structure according to a second embodiment of the invention.

Referring to FIG. 10, the adapter structure of the invention further includes a charging unit 60 electrically connecting to the plugs 20, 30. The charging unit 60 charges the electrical appliance or a secondary batter, providing a charging function to the adapter structure.

The plug 30 can be used in an electrical socket of UK or EU electricity standards according to the unfolded length of the plug 30. When the plug 30 is unfolded with a longer extension, it is used for the EU standard. When the plug 30 is unfolded with a shorter extension, it is used for the UK standard.

Furthermore, the undercuts 33 are respectively formed inside the rod-shaped pins 31 of the plug 30 to facilitate a smooth insertion of the plug 30 into the electrical sockets of EU and UK electricity standards. The rod-shaped pins 31 and the base 32 are long and resilient. Therefore, even without the formation of the undercuts 33, the rod-shaped pins 31 still can move outward to prevent obstruction caused by a small pitch between two insertion holes of the electrical socket of UK electricity standard.

Figure 11:
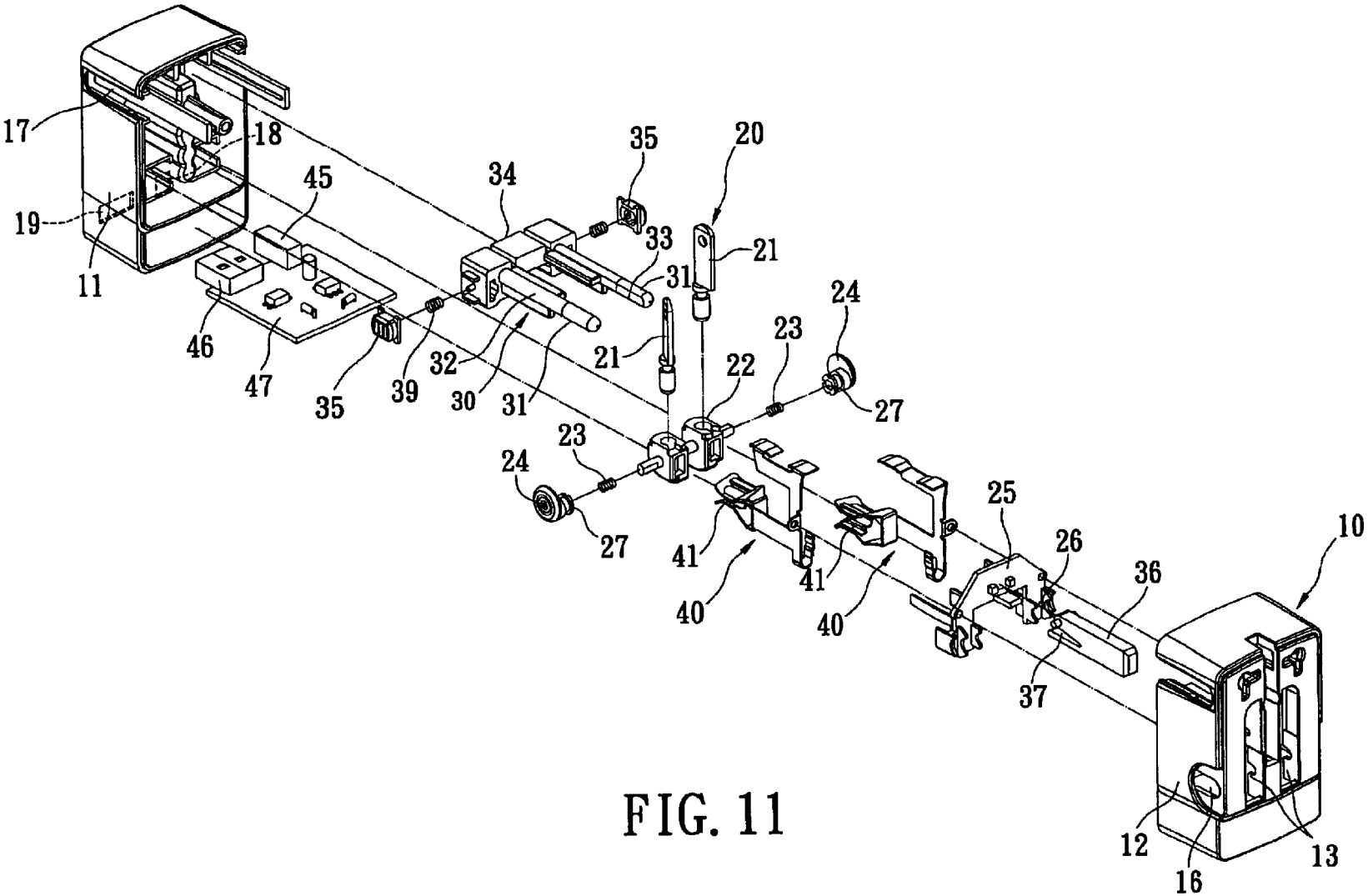
FIG. 11 is an exploded view of an adapter structure according to a third embodiment of the invention.

Referring to FIG. 11, a circuit board 47 is further mounted inside the casing 10 to electrically connect to the conductors 40. The circuit board 47 has a first connector 45 and a second connector 46, and openings 18, 19 respectively corresponding to the connectors 45, 46. The connectors 45, 46 are, for example, USB connectors or electrical sockets. The circuit board 47 electrically connects to the plugs 20, 30 for outputting power via the plugs 20, 30.

Figure 12:
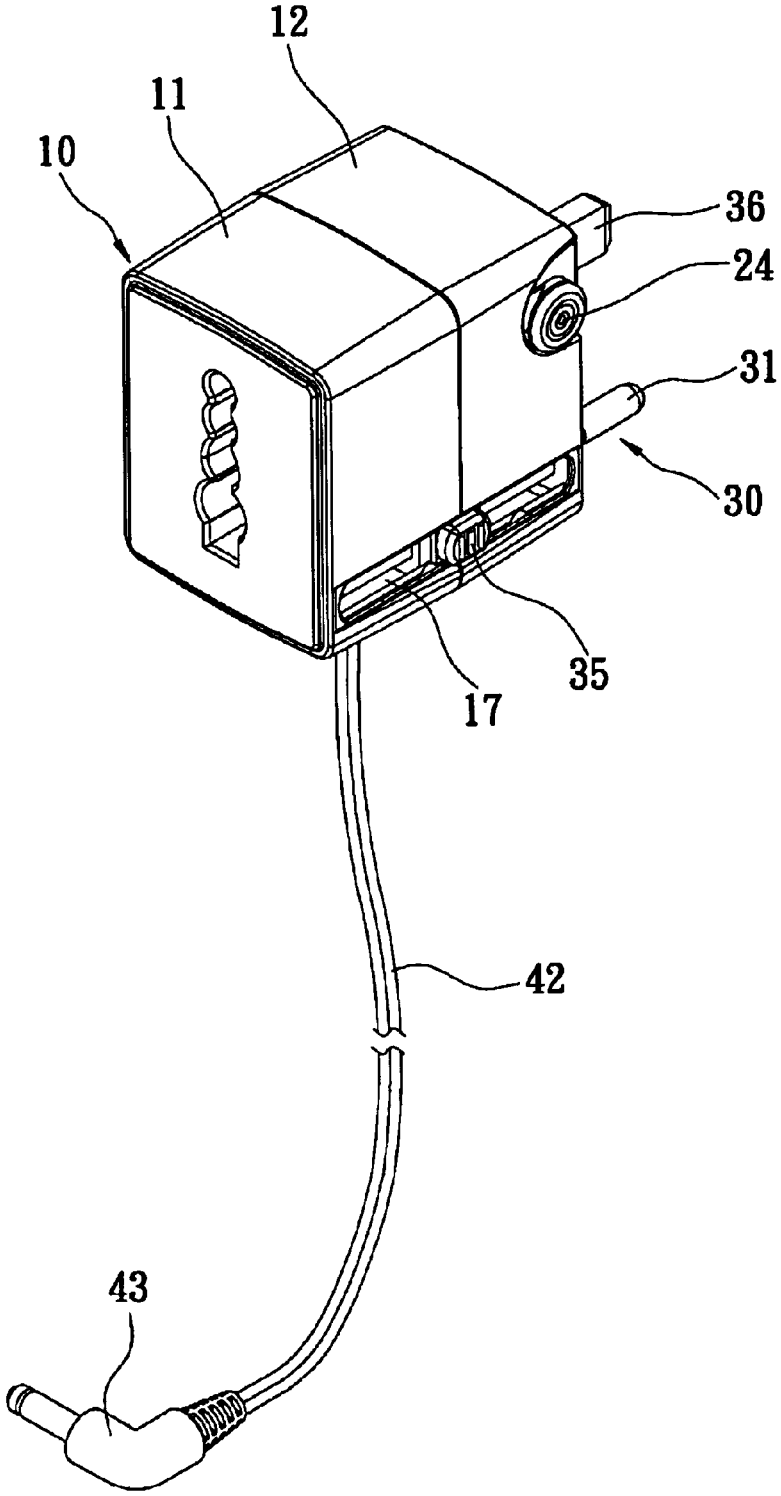
FIG. 12 is a perspective view of an adapter structure according to a fourth embodiment of the invention.
Figure 13:
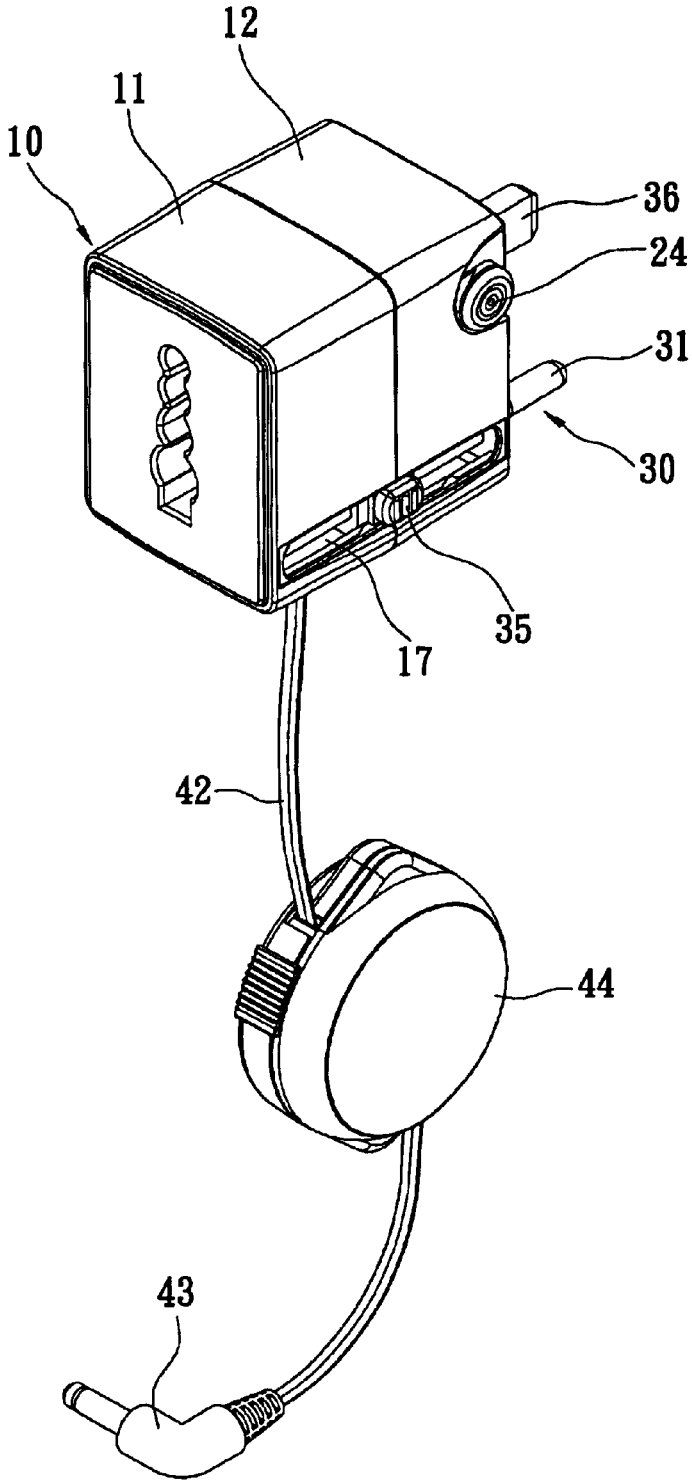
FIG. 13 is a perspective view of an adapter structure according to a fifth embodiment of the invention.
Figure 14:
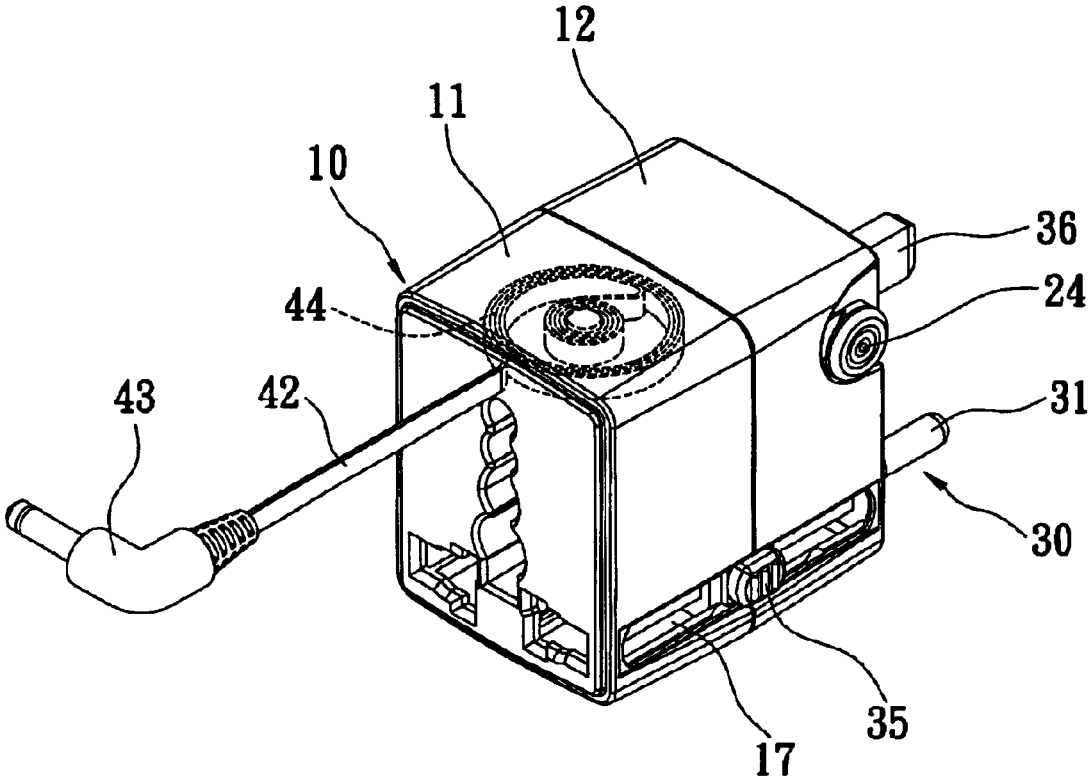
FIG. 14 is a perspective view of an adapter structure according to a sixth embodiment of the invention.

Referring to FIG. 12, an output line 42 is further provided. One end of the output line 42 electrically connects to the circuit board 47. The other end of the output line 42 penetrates through the casing 10 to connect to an output plug 43 for outputting the power via the plugs 20, 30. The output line 42 further has a winding reel 44 (as shown in FIG. 13) to wind the output line 42. The winding reel 44 can be mounted on the casing 10 as shown in FIG. 14.

Provided with plugs 20, 30 of different electricity standards, the adapter structure of the invention allows the user to conveniently choose the proper plug according to a domestic electricity standard, for example UK standard or EU standard. The adapter of the invention has a simple structure with reduced size and production cost.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. An adapter structure, suitable for use with different electricity standards, comprising:

a casing;

a first plug, having a pair of straight pins pivotally connecting to the casing so that the straight pins are unfolded to extend from the casing or stored inside the casing, the straight pins being displaceable responsive to manipulation of a pair of pivotally displaceable covers operably coupled thereto through the casing;

a second plug, having a pair of bases projecting from a sliding piece and a pair of rod-shaped pins respectively connected to extend from the bases, wherein the sliding piece is connected to a pushing button for selectively displacing the second plug between retracted and first and second extended positions, the bases in the first extended position remaining disposed within the casing, the bases in the second extended position extending with the rod-shaped pins from the casing;

a plurality of conductors, mounted inside the casing and respectively connected to the first and second plugs, wherein each of the conductors has an a plurality of insertion holes, formed through one side of the casing to correspond to a pair of the outlets of the conductor;

whereby the plugs of the adapter are selectively extended from the casing to accommodate a plurality of electricity standards.

2. The adapter structure of claim 1, wherein a circuit board is further mounted inside the casing to connect electrically to the conductors.

3. The adapter structure of claim 1, wherein the straight pins of the first plug are stored inside a first portion of the casing and securely inserted in a connection base, the cover being pivotally mounted in spring biased manner on each of two opposite sides of the connection base.

4. The adapter structure of claim 3, wherein a positioning sheet having two protuberances thereon is mounted in the casing, a plurality of first slots being formed on each cover so that the protuberances snap fit to the first slots.

5. The adapter structure of claim 1, wherein an undercut is formed inside each of the rod-shaped pins of the second plug, a sliding piece being detachably mounted on a rear side of the base to allow the rod-shaped pins to be slidably mounted inside the casing.

6. The adapter structure of claim 1, wherein the second plug further includes a rectangular ground pin that either unfolds forward or stores up inside the casing.

7. The adapter structure of claim 6, wherein the ground pin has an elongate slot formed at a rear end thereof, a first positioning member being mounted on the casing, and when the ground pin is rotated to unfold forward, the second slot of the ground pin snap fits to a second positioning member for reinforcing the ground pin to remain extended from the casing.

8. The adapter structure of claim 1, further comprising a charging unit electrically connecting to the first and second plugs.

9. An adapter structure, suitable for different electricity standards, comprising:

a casing;

a first plug, having a pair of straight pins pivotally connecting to the casing so that the straight pins are unfolded to extend from the casing or stored inside the casing, the straight pins being displaceable responsive to manipulation of a pair of pivotally displaceable covers operably coupled thereto through the casing;

a second plug, having a pair of bases projecting from a sliding piece and a pair of rod-shaped pins respectively connected to extend from the bases, wherein the sliding piece is connected to a pushing button for selectively displacing the second plug between retracted and first and second extended positions, the bases in the first extended position remaining disposed within the casing, the bases in the second extended position extending with the rod-shaped pins from the casing;

a plurality of conductors, mounted inside the casing and respectively connected to the pins of the first and second plugs; and an output line, electrically connected to a circuit board electrically connected to the conductors, wherein one end of the output line connects to an output plug.

10. The adapter structure of claim 9, wherein the output line has a winding reel.

11. An adapter structure, suitable for different electricity standards, comprising:

a casing:

a first plug, having a pair of straight pins pivotally connecting to the casing so that the straight pins are unfolded to extend from the casing or stored inside the casing, the straight pins being displaceable responsive to manipulation of a pair of pivotally displaceable covers operably coupled thereto through the casing;

a second plug, having a pair of bases projecting from a sliding piece and a pair of rod-shaped pins respectively connected to extend from the bases, wherein the sliding piece is connected to a pushing button for selectively displacing the second plug between retracted and first and second extended positions, the bases in the first extended position remaining disposed within the casing, the bases in the second extended position extending with the rod-shaped pins from the casing;

a plurality of conductors, mounted inside the casing and respectively connected to the pins of the first and second plugs; and a circuit board electrically connected to the conductors, wherein the circuit board has a connector.

* * * * *